US008925515B2

(12) United States Patent
McMullen

(10) Patent No.: US 8,925,515 B2
(45) Date of Patent: Jan. 6, 2015

(54) POWER SYSTEM COMPRISING A TURBOCHARGER BYPASS PASSAGE

(71) Applicant: Deere & Company, Moline, IL (US)

(72) Inventor: Robert J. McMullen, Waterloo, IA (US)

(73) Assignee: Deere & Company, Moline, IL (US)

( * ) Notice: Subject to any disclaimer, the term of this patent is extended or adjusted under 35 U.S.C. 154(b) by 131 days.

(21) Appl. No.: 13/778,491

(22) Filed: Feb. 27, 2013

(65) Prior Publication Data

US 2014/0238336 A1 Aug. 28, 2014

(51) Int. Cl.
*F01M 11/10* (2006.01)

(52) U.S. Cl.
USPC ..... 123/196 S; 184/6.5

(58) Field of Classification Search
CPC ..... Y02T 10/144; F02B 39/14; F02B 39/16; F02B 37/186; F01M 1/02; F01M 1/12; F01M 1/16; F01M 1/18; F16C 2360/24; B60Y 2400/435
USPC ..... 123/196 R, 196 S; 184/6.5; 701/107
See application file for complete search history.

(56) References Cited

U.S. PATENT DOCUMENTS

| | | | |
|---|---|---|---|
| 5,447,031 | A | 9/1995 | Betts et al. |
| 6,155,050 | A | 12/2000 | Blanz et al. |
| 6,209,390 | B1 | 4/2001 | LaRue et al. |
| 7,908,858 | B2 | 3/2011 | Gehrke et al. |
| 7,912,620 | B2 | 3/2011 | French et al. |
| 2007/0283695 | A1 | 12/2007 | Figura |

FOREIGN PATENT DOCUMENTS

| | | | |
|---|---|---|---|
| DE | 3002362 | A1 | 8/1980 |
| DE | 19959485 | A1 | 6/2001 |
| GB | 2487473 | A | 7/2012 |
| JP | 60040731 | A | 3/1985 |
| KR | 20020073745 | A | 9/2002 |
| WO | 8100592 | | 3/1981 |
| WO | 2008122756 | A1 | 10/2008 |
| WO | 2011129824 | A1 | 10/2011 |

OTHER PUBLICATIONS

European Search Report issued in counterpart application No. 14154502.0, dated Sep. 1, 2014 (5 pages).

*Primary Examiner* — Noah Kamen

(57) ABSTRACT

A power system, comprising a turbocharger, an oil sump, a supply passage, a return passage, and a turbocharger bypass passage. The supply passage is positioned fluidly between the turbocharger and the oil sump and is configured to supply oil to the turbocharger. The return passage is positioned fluidly between the turbocharger and the oil sump and is configured to return oil from the turbocharger to the oil sump. The turbocharger bypass passage is positioned fluidly between the supply passage and the return passage. The turbocharger bypass passage comprises a valve that is configured to be in a closed positioned when the turbocharger is in a normal operating mode, and in an open position when the turbocharger is in a failure mode.

13 Claims, 2 Drawing Sheets

AOC
SCR
DOC
DPF
EGR Cooler
ECU

POWER SYSTEM COMPRISING A TURBOCHARGER BYPASS PASSAGE

FIELD OF THE DISCLOSURE

The present disclosure relates to a power system comprising a turbocharger bypass passage.

BACKGROUND OF THE DISCLOSURE

All engines—diesel, gasoline, propane, and natural gas—produce exhaust gas containing carbon monoxide, hydrocarbons, and nitrogen oxides. These emissions are the result of incomplete combustion. Diesel engines also produce particulate matter. As more government focus is being placed on health and environmental issues, agencies around the world are enacting more stringent emission's laws.

Because so many diesel engines are used in trucks, the U.S. Environmental Protection Agency and its counterparts in Europe and Japan first focused on setting emissions regulations for the on-road market. While the worldwide regulation of nonroad diesel engines came later, the pace of cleanup and rate of improvement has been more aggressive for nonroad engines than for on-road engines.

Manufacturers of nonroad diesel engines are expected to meet set emissions regulations. For example, Tier 3 emissions regulations required an approximate 65 percent reduction in particulate matter (PM) and a 60 percent reduction in $NO_x$ from 1996 levels. As a further example, Interim Tier 4 regulations required a 90 percent reduction in PM along with a 50 percent drop in $NO_x$. Still further, Final Tier 4 regulations, which will be fully implemented by 2015, will take PM and $NO_x$ emissions to near-zero levels.

Many Tier 3, interim Tier 4, and Final Tier 4 engines comprise turbochargers, which are well known devices for supplying intake gas to the engine at pressures above atmospheric pressure. Under some operating conditions, the turbocharger may be prone to failure, leading to oil entering the intake system and/or exhaust system of the engine.

SUMMARY OF THE DISCLOSURE

According to the present disclosure, a power system is disclosed that comprises a turbocharger, an oil sump, a supply passage, a return passage, and a turbocharger bypass passage. The supply passage is positioned fluidly between the turbocharger and the oil sump and is configured to supply oil to the turbocharger. The return passage is positioned fluidly between the turbocharger and the oil sump and is configured to return oil from the turbocharger to the oil sump. The turbocharger bypass passage is positioned fluidly between the supply passage and the return passage. The turbocharger bypass passage comprises a valve that is configured to be in a closed positioned when the turbocharger is in a normal operating mode, and in an open position when the turbocharger is in a failure mode.

In such a power system, if the turbocharger is fails, then the bypass valve opens and allows the oil to bypass the turbocharger, mitigating the risk of oil entering the intake system and/or exhaust system of the engine.

BRIEF DESCRIPTION OF THE DRAWINGS

The detailed description of the drawings refers to the accompanying figures in which.

DETAILED DESCRIPTION OF THE DRAWINGS

Figure 1:
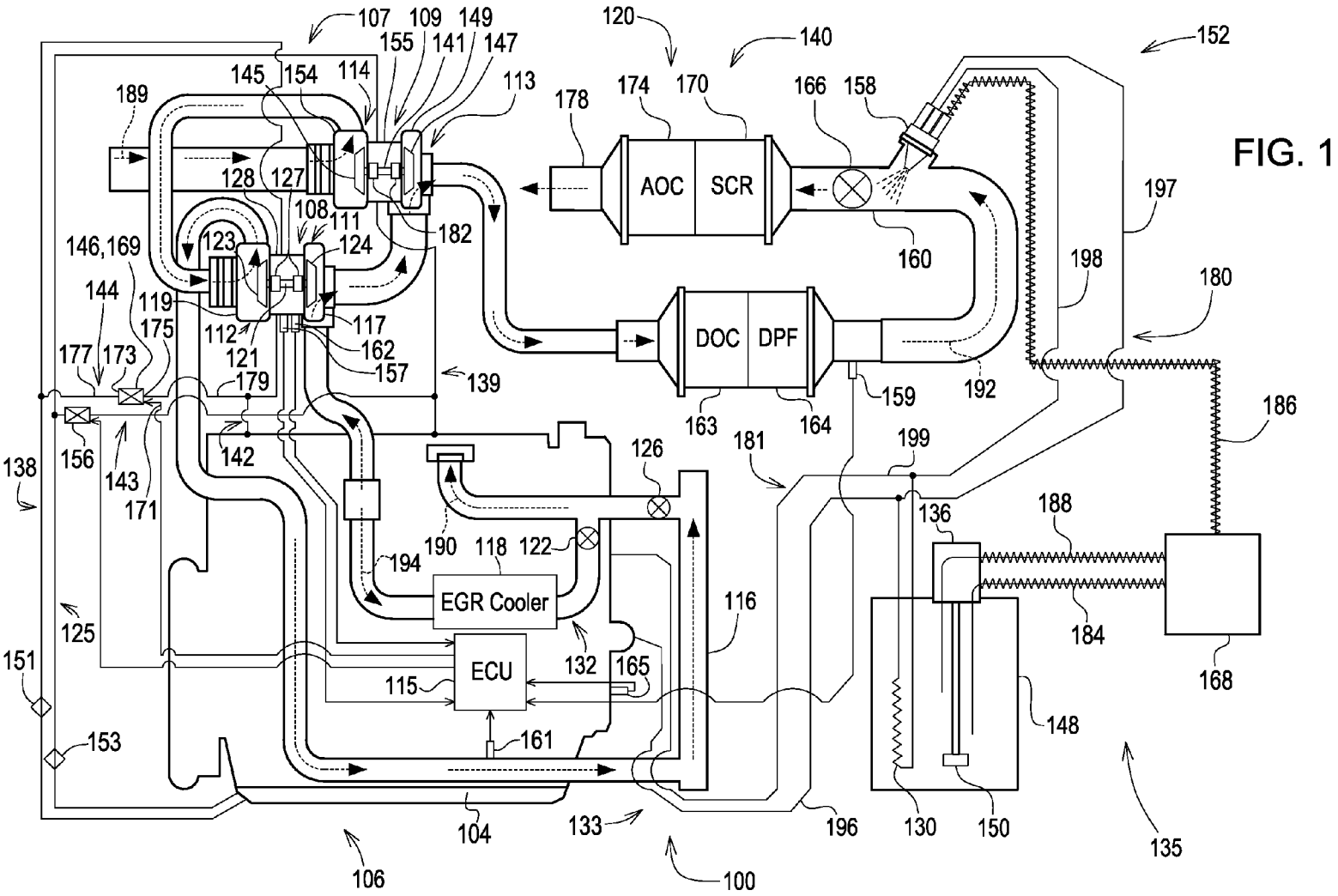
FIG. 1. is a diagrammatic view of a power system comprising a turbocharger bypass passage.

Referring to FIG. 1, there is shown a schematic illustration of a power system 100 comprising an engine 106. The power system 100 may be used for providing power to a variety of machines, including on-highway trucks, construction vehicles, marine vessels, stationary generators, automobiles, agricultural vehicles, and recreation vehicles.

The engine 106 may be any kind of engine 106 that produces an exhaust gas, the exhaust gas being indicated by directional arrow 192. For example, engine 106 may be an internal combustion engine, such as a gasoline engine, a diesel engine, a gaseous fuel burning engine (e.g., natural gas) or any other exhaust gas producing engine. The engine 106 may be of any size, with any number cylinders (not shown), and in any configuration (e.g., "V," inline, and radial). The engine 106 may include various sensors, such as temperature sensors, pressure sensors, and mass flow sensors.

The power system 100 may comprise an intake system 107. The intake system 107 may comprise components configured to introduce a fresh intake gas, indicated by directional arrow 189, into the engine 106. For example, the intake system 107 may comprise an intake manifold (not shown) in communication with the cylinders, a compressor 112, a charge air cooler 116, and an air throttle actuator 126.

Exemplarily, the compressor 112 may be a fixed geometry compressor, a variable geometry compressor, or any other type of compressor configured to receive the fresh intake gas, from upstream of the compressor 112. The compressor 112 compress the fresh intake gas to an elevated pressure level. As shown, the charge air cooler 116 is positioned downstream of the compressor 112, and it is configured to cool the fresh intake gas. The air throttle actuator 126 may be positioned downstream of the charge air cooler 116, and it may be, for example, a flap type valve controlled by an electronic control unit (ECU) 115 to regulate the air-fuel ratio.

Further, the power system 100 may comprise an exhaust system 140. The exhaust system 140 may comprise components configured to direct exhaust gas from the engine 106 to the atmosphere. Specifically, the exhaust system 140 may comprise an exhaust manifold (not shown) in fluid communication with the cylinders.

During an exhaust stroke, at least one exhaust valve (not shown) opens, allowing the exhaust gas to flow through the exhaust manifold and a turbine 111. The pressure and volume of the exhaust gas drives the turbine 111, allowing it to drive the compressor 112 via a shaft 121. The combination of the compressor 112, the shaft 121, and the turbine 111 is known as a turbocharger 108.

The turbocharger 108 also comprises a turbine housing 117 connected to a compressor housing 119 via a bearing housing 128. A turbine wheel 124 rotates on one end of a shaft 121 within the turbine housing 117. A compressor wheel 123 is mounted to the opposite end of the shaft 121 within the compressor housing 119. The shaft 121 passes through the bearing housing 128 and rotates on bearing assemblies 127.

Exemplarily, the turbocharger 108 may be a fixed geometry turbocharger, a variable geometry turbocharger, or any other type of turbocharger configured to receive the fresh intake gas, and compress the fresh intake gas to an elevated pressure level.

Seal assemblies (not shown) are mounted within the bearing housing 128 at both a compressor end and a turbine end of the shaft 121 in order to prevent oil leakage into the compressor housing 119 and the turbine housing 117, preventing oil from entering intake gas and/or the exhaust gas.

The oil cleans and flushes the moving parts of the turbocharger 108, reduces friction between the moving parts of the turbocharger 108, and cools the turbocharger 108 by promoting the absorption and dissipation of heat.

The ECU 115 may be programmed to determine the existence, or the possibility, of a serious failure of the turbocharger 108 (such as catastrophic failure), which may, for example, lead to oil leakage from the bearing housing 128. The main oil leakage problems are (1) a possibility of a leakage from the bearing housing 128 into the compressor housing 119 leading to oil ingestion by the engine 106; (2) the possibility of oil leakage from the bearing housing 128 into the turbine housing 117 leading to oil in the exhaust system 140; (3) the possibility of the supply passage 138 or the return passage 142 leaking so that oil leaks into the compartment of the engine 106; and (4) the possibility of spraying of oil from the turbocharger 108 into the engine compartment as a result of rupturing of the turbocharger 108 following a catastrophic failure, such as disintegration of the compressor housing 119 following extreme over speeding of the turbocharger 108, or damage due to impact. Oil leaking into the exhaust system 140 may contaminate, for example, the aftertreatment system 120. Although less common, oil may leak into the intake gas and be ignited in the combustion process, thereby providing an uncontrolled fuel supply, causing the engine 106 to overspeed.

Leakage in the supply passage 138 to the turbocharger 108 can be a particular problem, because the supply passage 138 is typically a high pressure oil passage that is external to the engine 106. Under some circumstances, the turbocharger 108 may fail, or the supply passage 138 may rupture, but the engine 106 may continue to run.

The ECU 115 determines the existence, or possibility, of a serious failure of the turbocharger 108 by measurement of various engine parameters from conventional sensors disposed around the engine 106 and the turbocharger 108, or from dedicated sensors added to the engine 106 and turbocharger 108. The existence, or possible occurrence, of a potentially hazardous situation can for instance be determined by comparing measured values with pre-determined stored values, or otherwise interpreted from the measured values, in response to which the ECU 115 (under appropriate programming) can operate to control the valve 146 to reduce, or completely shut-off the supply passage 138 to the turbocharger 108.

In the illustrated embodiment, a turbocharger speed sensor 157 may be used to monitor the rotational speed of the turbocharger 108. The ECU 115 may be programmed to open the valve 146 if the speed of the turbocharger 108 reaches or exceeds a predetermined limit indicative of over speeding and potentially catastrophic failure of the turbocharger 108. The ECU 115 may be programmed to open the valve 146 if the monitored rotational speed of the turbocharger 108 drops unexpectedly, or drops to zero, indicating the potential failure of the turbocharger 108. Similarly, the supply passage 138 could be stopped if the turbocharger speed sensor 157 fails to transmit any data at all, which would be another indicator of likely failure of the turbocharger 108. A turbocharger speed sensor (not shown) may also be provided on an upstream turbocharger 109, and it may operate, in combination with the ECU 115, like the turbocharger speed sensor 157 does.

The turbocharger 108 may fail as a result of fatigue—also known as cyclic stress—of, for example, the compressor wheel 123, the turbine wheel 124, or any other rotating component of the turbocharger 108. Exemplarily, a first failure mode occurs as a result of blade vibration. Varying of the exhaust gas flow and fresh intake gas flow causes the blades (not shown) of the the compressor wheel 123 and turbine wheel 124, respectively. Exemplarily, a second failure mode occurs as a result of the shaft 121 speeding up and slowing down, causing increasing and decreasing stresses on the turbine wheel 124 and the compressor wheel 123. In the both failure modes, the failure of the compressor wheel 123 and/or the turbine wheel 124 may cause the bearing assemblies 127 to fail. Such a failure may be particularly prevalent in power systems comprising, for example, natural gas engines. Natural gas engines may sometimes be used in transit buses, and such engines may require the turbocharger 108 and the upstream turbocharger 109 to operate with a lot of cycles, thereby leading to premature failure.

The power system 100 comprises an oil sump 104. The supply passage 138 is positioned fluidly between the turbocharger 108 and the oil sump 104 and, as noted above, is configured to supply oil to the turbocharger 108. The supply passage 138 may comprise an oil filter 151. The return passage 142 is positioned fluidly between the turbocharger 108 and the oil sump 104, and it is configured to return oil from the turbocharger 108 to the oil sump 104.

The turbocharger bypass passage 144 is positioned fluidly between the supply passage 138 and the return passage 142. The turbocharger bypass passage 144 comprises a valve 146 that is configured to be in a closed positioned when the turbocharger 108 is in a normal operating mode, and in an open position when the turbocharger 108 is in a failure mode. In the illustrated embodiment, the turbocharger 108 and the valve 146 may be positioned in parallel relative to one another. And in some embodiments, the turbocharger bypass passage 144 may be formed into an engine casting, such as an engine block.

The turbocharger 108 may be positioned such that, when the turbocharger 108 is in the failure mode, gravity urges the oil to flow away from the turbocharger 108 and through the turbocharger bypass passage 144 and the return passage 142 (i.e., the turbocharger 108 is above the oil sump 104). In one embodiment, for example, the turbocharger 108 may be positioned above a rocker arm cover (not shown) of the engine 106.

The supply passage 138, the return passage 142, and the turbocharger bypass passage 144 may all be made of stainless steel, braided hoses. Such hoses—or any other kind of braided hoses—may withstand the vibration of turbocharger 108 more effectively than, for example, rigid hoses. In other embodiments, the turbocharger bypass passage 144, the supply passage 138, and the return passage 142 may all be rigid tubes. In such embodiments, the turbocharger bypass passage 144 may be welded to the supply passage 138 and the return passage 142.

The power system 100 may not comprise a valve positioned in the supply passage 138. If a valve is positioned there, then the valve could potentially block the oil supply and starve the turbocharger 108 of oil, particularly upon startup of the engine 106. In such a design, the turbocharger 108 may be starved of oil for 30 seconds or longer upon startup, causing the turbocharger 108 to fail prematurely (e.g., 1000 hours of operation or less). Additionally, if a valve is positioned in the supply passage 138, then the valve would likely be prone to oil leaks, particularly around any electrical wiring and solenoids that it might have. This is because the oil in the supply passage 138 is at relatively high pressures, in contrast to the oil in the return passage 142 that is at a relatively low pressures.

The valve 146 may be a check valve 169, and it may be configured to prevent the oil from flowing away from the return passage 142 and towards the supply passage 138. The check valve 169 may be electronically actuated in response to a signal indicating when the turbocharger 108 is in the normal operating mode, and to a signal indicating when the turbocharger 108 is in the failure mode. In the embodiment shown, the check valve 169 may comprise an electrical connection 171, and it may also comprise a first side 173 and a second side 175. The turbocharger bypass passage 144 may comprise a first portion 177 and a second portion 179—the first portion 177 being positioned between the supply passage 138 and the first side 173, and the second portion 179 being positioned between the return passage 142 and the second side 175. As shown, the electrical connection 171 may be positioned on the second side 175 of the check valve 169, the second side 175 being the side that is typically operating a relatively low pressure as compared to the first side 173. Placing the electrical connection 171, on the second side 175, may be advantageous in some embodiments of the power system 100, because it may be less prone to leaks.

The valve 146 may be a butterfly valve, flap valve, rotary valve, ball valve, sliding plate valve, and the like. Although the valve 146 is shown as being controlled by the ECU 115, in other embodiments, a separate controller may be provided. The separate controller may, for example, receive a signal from the ECU 115, or it may directly receive the same control signals provided to the ECU 115 by sensors around the engine 106, or control signals from a subset of those sensors, or may receive control signals independent from other management functions of the engine 106.

As shown, the aftertreatment system 120 may comprise a temperature sensor 159. The ECU 115 may be programmed to close the valve 146 in the event that the monitored temperature reaches or exceeds a predetermined temperature indicative of, for instance, failure of the turbocharger 108 with a resultant likelihood of failure and oil leakage problems.

A boost pressure sensor 161 may also be provided to monitor the boost pressure produced by the turbocharger 108. Again, the ECU 115 can be programmed to open the valve 146 if the monitored boost pressure reaches or exceeds a predetermined limit or drops below a predetermined limit, indicating a likelihood of failure of the compressor 112, and rupturing of the compressor housing 119, and/or rupturing of the bearing housing 128.

As illustrated, an acceleration sensor 162 may be provided on, for example, turbocharger 108 to detect extreme acceleration as might be encountered in a collision or catastrophic failure of the turbocharger 108, such as a wheel burst, and the ECU 115 may be programmed to open the valve 146 on detection of such an acceleration condition. Similarly, an acceleration sensor (not shown) may also be provided on the upstream turbocharger 109.

An engine crankcase pressure sensor 165 may be provided to monitor the crankcase pressure and the ECU 115 may be programmed to open the valve 146 if the monitored pressure reaches or exceeds a determined value (for instance of the order of about 150 millibars). Typically, the crankcase pressure is relatively low (i.e., no more than about 20 millibars). Thus, an abnormally high crankcase pressure may indicate a serious failure of either the engine 106 or the turbocharger 108. For example, if a piston (not shown) is badly scuffed, or a cylinder valve stem fails, large quantities of blow-by gas can enter the crankcase and increase the crankcase pressure.

In some cases, even a crankcase ventilation valve (not shown), which may be provided to control crankcase pressure, may be unable to handle such a sudden, large increase in blow-by gas. Similarly, crankcase pressure would rise if the crankcase ventilation valve fails or if the seals of the shaft 121 fail, thereby leading to increased blow-by. Increased crankcase pressure may, in some cases, force oil from the bearing housing 128 and into the intake manifold (so as to be ingested by the engine 106), or into the exhaust system 140.

The ECU 115 may open the valve 146 on the basis of signals from a single sensor, or on the basis of a combination of signals from a plurality of sensors meeting a particular condition. For example, the ECU 115 may be programmed to open the valve 146 when both the speed and the boost pressure of the turbocharger 108 drops to zero, indicating a serious problem. But it may be programmed not to open the valve 146 when only one of these values drops to zero, indicating a potentially less serious problem.

Upon the detection of a condition likely to result in oil leakage from the turbocharger 108 or the supply passage 138, or upon detection of the possibility of the occurrence of such a condition, the turbocharger 108 can be bypassed via the turbocharger bypass passage 144. This reduces the amount of oil that can leak into the intake gas, the exhaust gas, or the engine 106, thereby reducing the risk of problems associated with such leakage.

Additionally, the power system 100 may include an accelerometer (not shown) on or adjacent to the shaft 121 to detect the failure thereof, so that the valve can be opened in response to detection of such a condition.

The sensors illustrated, in FIG. 1, are examples of appropriate sensors that may be included in the power system 100. In other embodiments, greater or fewer sensors may be included. The illustrated sensors are of a type that may typically be included in a power system—such as the power system 100—and are not necessarily sensors dedicated to controlling just the valve 146. The information required by the ECU 115 for control of the valve 146 may be obtained from existing sensors.

As shown, the power system 100 may also comprise, for example, an upstream turbocharger 109 that cooperates with the turbocharger 108. Exemplarily, the upstream turbocharger 109 may be a fixed geometry turbocharger, a variable geometry turbocharger, or any other type of turbocharger configured to receive the fresh intake flow and compress the fresh intake flow to an elevated pressure level.

The upstream turbocharger 109 comprises a second compressor 114, a second shaft 141, and a second turbine 113. Additionally, the upstream turbocharger 109 comprises a second turbine housing 149 connected to a second compressor housing 154 via a second bearing housing 155. A second turbine wheel 147 rotates on one end of a second shaft 141 within the second turbine housing 149, and a second compressor wheel 145 is mounted to the opposite end of the second shaft 141 within the second compressor housing 154. The second shaft 141 passes through the second bearing housing 155 and rotates on second bearing assemblies 182.

As shown, the upstream turbocharger 109 is positioned upstream of the turbocharger 108. In such an embodiment, the turbocharger 108 may be referred to as a "high pressure turbocharger," and the upstream turbocharger 109 may be referred to as a "low pressure turbocharger." This is because the fresh intake gas that passes through turbocharger 108 has already been pressurized by the upstream turbocharger 109 positioned upstream thereof. And for this reason, the turbocharger 108 experiences larger forces than the upstream turbocharger 109, and it may, therefore, be more prone to the first and second failure modes discussed above, as compared to the upstream turbocharger 109.

The power system 100 may comprise a second supply passage 125, second return passage 139, and a second turbocharger bypass passage 143. The second supply passage 125 may be positioned fluidly between the upstream turbocharger 109 and the oil sump 104, and the second supply passage 125 may be configured to supply oil to the upstream turbocharger 109. The second supply passage 125 may comprise a second oil filter 153.

The second return passage 139 may be positioned fluidly between the upstream turbocharger 109 and oil sump 104, and accordingly, the second return passage 139 may be configured to return oil from the upstream turbocharger 109 to the oil sump 104.

And the second turbocharger bypass passage 143 may be positioned fluidly between the second supply passage 125 and the second return passage 139. The second turbocharger bypass passage 143 may comprise a second valve 156, the second valve 156 being configured to be in a closed positioned when the upstream turbocharger 109 is in a normal operating mode, configured to be in an open position when the upstream turbocharger 109 is in a failure mode. In some embodiments, the second turbocharger bypass passage 143 may be formed into an engine casting, such as an engine block.

Although not shown in the illustrated embodiment, the second turbocharger bypass passage 143 may be positioned fluidly between the second supply passage 125 and the return passage 188. Or, though also not shown in the illustrated embodiment, the second return passage 139 may be positioned fluidly between the upstream turbocharger 109 and, for example, the return passage 188. Such alternative embodiments may provide, for example, clearance advantages. In yet other embodiments of the power system 100, the second turbocharger bypass passage 143 may positioned slightly differently, depending upon other design considerations.

The power system 100 may also comprises an exhaust gas recirculation (EGR) system 132 that is configured to receive a recirculated portion of the exhaust gas, as indicated by directional arrow 194. The intake gas is indicated by directional arrow 190, and it is a combination of the fresh intake gas and the recirculated portion of the exhaust gas. The EGR system 132 comprises an EGR valve 122, an EGR cooler 118, and an EGR mixer (not shown).

The EGR valve 122 may be a vacuum controlled valve, allowing a specific amount of the recirculated portion of the exhaust gas back into the intake manifold. The EGR cooler 118 is configured to cool the recirculated portion of the exhaust gas flowing therethrough. Although the EGR valve 122 is illustrated as being downstream of the EGR cooler 118, it may also be positioned upstream from the EGR cooler 118. The EGR mixer is configured to mix the recirculated portion of the exhaust gas and the fresh intake gas into, as noted above, the intake gas.

As further shown, the exhaust system 140 may comprise an aftertreatment system 120, and at least a portion of the exhaust gas passes therethrough. The aftertreatment system 120 is configured to remove various chemical compounds and particulate emissions present in the exhaust gas received from the engine 106. After being treated by the aftertreatment system 120, the exhaust gas is expelled into the atmosphere via a tailpipe 178.

In the illustrated embodiment, the aftertreatment system 120 comprises a diesel oxidation catalyst (DOC) 163, a diesel particulate filter (DPF) 164, and a selective catalytic reduction (SCR) system 152. The SCR system 152 comprises a reductant delivery system 135, an SCR catalyst 170, and an ammonia oxidation catalyst (AOC) 174. Exemplarily, the exhaust gas flows through the DOC 163, the DPF 164, the SCR catalyst 170, and the AOC 174, and is then, as just mentioned, expelled into the atmosphere via the tailpipe 178.

In other words, in the embodiment shown, the DPF 164 is positioned downstream of the DOC 163, the SCR catalyst 170 downstream of the DPF 164, and the AOC 174 downstream of the SCR catalyst 170. The DOC 163, the DPF 164, the SCR catalyst 170, and the AOC 174 may be coupled together. Exhaust gas treated, in the aftertreatment system 120, and released into the atmosphere contains significantly fewer pollutants—such as diesel particulate matter, $NO_2$, and hydrocarbons—than an untreated exhaust gas.

The DOC 163 may be configured in a variety of ways and contain catalyst materials useful in collecting, absorbing, adsorbing, and/or converting hydrocarbons, carbon monoxide, and/or oxides of nitrogen contained in the exhaust gas. Such catalyst materials may include, for example, aluminum, platinum, palladium, rhodium, barium, cerium, and/or alkali metals, alkaline-earth metals, rare-earth metals, or combinations thereof. The DOC 163 may include, for example, a ceramic substrate, a metallic mesh, foam, or any other porous material known in the art, and the catalyst materials may be located on, for example, a substrate of the DOC 163. The DOC(s) may also be configured to oxidize NO contained in the exhaust gas, thereby converting it to $NO_2$. Or, stated slightly differently, the DOC 163 may assist in achieving a desired ratio of NO to $NO_2$ upstream of the SCR catalyst 170.

The DPF 164 may be any of various particulate filters known in the art configured to reduce particulate matter concentrations, e.g., soot and ash, in the exhaust gas to meet requisite emission standards. Any structure capable of removing particulate matter from the exhaust gas of the engine 106 may be used. For example, the DPF 164 may include a wall-flow ceramic substrate having a honeycomb cross-section constructed of cordierite, silicon carbide, or other suitable material to remove the particulate matter. The DPF 164 may be electrically coupled to a controller, such as the ECU 115, that controls various characteristics of the DPF 164.

If the DPF 164 were used alone, it would initially help in meeting the emission requirements, but would quickly fill up with soot and need to be replaced. Therefore, the DPF 164 is combined with the DOC 163, which helps extend the life of the DPF 164 through the process of regeneration. The ECU 115 may be configured to measure the PM build up, also known as filter loading, in the DPF 164, using a combination of algorithms and sensors. When filter loading occurs, the ECU 115 manages the initiation and duration of the regeneration process.

Moreover, the reductant delivery system 135 may comprise a reductant tank 148 configured to store the reductant. One example of a reductant is a solution having 32.5% high purity urea and 67.5% deionized water (e.g., DEF), which decomposes as it travels through a decomposition tube 160 to produce ammonia. Such a reductant may begin to freeze at approximately 12 deg F (−11 deg C). If the reductant freezes when a machine is shut down, then the reductant may need to be thawed before the SCR system 152 can function.

The reductant delivery system 135 may comprise a reductant header 136 mounted to the reductant tank 148, the reductant header 136 further comprising, in some embodiments, a level sensor 150 configured to measure a quantity of the reductant in the reductant tank 148. The level sensor 150 may comprise a float configured to float at a liquid/air surface interface of reductant included within the reductant tank 148. Other implementations of the level sensor 150 are possible, and may include, exemplarily, one or more of the following: (a) using one or more ultrasonic sensors; (b) using one or more optical liquid-surface measurement sensors; (c) using one or more pressure sensors disposed within the reductant tank 148; and (d) using one or more capacitance sensors.

In the illustrated embodiment, the reductant header 136 comprises a tank heating element 130 that is configured to receive coolant from the engine 106, and the power system 100 may comprise a cooling system 133 that comprises a coolant supply passage 180 and a coolant return passage 181. A first segment 196 of the coolant supply passage 180 is positioned fluidly between the engine 106 and the tank heating element 130 and is configured to supply coolant to the tank heating element 130. The coolant circulates, through the tank heating element 130, so as to warm the reductant in the reductant tank 148, therefore reducing the risk that the reductant freezes therein. In an alternative embodiment, the tank heating element 130 may, instead, be an electrically resistive heating element.

A second segment 197 of the coolant supply passage 180 is positioned fluidly between the tank heating element 130 and a reductant delivery mechanism 158 and is configured to supply coolant thereto. The coolant heats the reductant delivery mechanism 158, reducing the risk that reductant freezes therein.

A first segment 198 of the coolant return passage 181 is positioned between the reductant delivery mechanism 158 and the tank heating element 130, and a second segment 199 of the coolant return passage 181 is positioned between the engine 106 and the tank heating element 130. The first segment 198 and the second segment 199 are configured to return the coolant to the engine 106.

The decomposition tube 160 may be positioned downstream of the reductant delivery mechanism 158 but upstream of the SCR catalyst 170. The reductant delivery mechanism 158 may be, for example, an injector that is selectively controllable to inject reductant directly into the exhaust gas. As shown, the SCR system 152 may comprise a reductant mixer 166 that is positioned upstream of the SCR catalyst 170 and downstream of the reductant delivery mechanism 158.

The reductant delivery system 135 may additionally comprise a reductant pressure source (not shown) and a reductant extraction passage 184. The reductant extraction passage 184 may be coupled fluidly to the reductant tank 148 and the reductant pressure source therebetween. Exemplarily, the reductant extraction passage 184 is shown extending into the reductant tank 148, though in other embodiments the reductant extraction passage 184 may be coupled to an extraction tube via the reductant header 136. The reductant delivery system 135 may further comprise a reductant supply module 168, and it may comprise the reductant pressure source. Exemplarily, the reductant supply module 168 may be, or be similar to, a Bosch reductant supply module, such as the one found in the "Bosch Denoxtronic 2.2—Urea Dosing System for SCR Systems."

The reductant delivery system 135 may also comprise a reductant dosing passage 186 and a reductant return passage 188. The reductant return passage 188 is shown extending into the reductant tank 148, though in some embodiments of the power system 100, the reductant return passage 188 may be coupled to a return tube via the reductant header 136.

The reductant delivery system 135 may comprise—among other things—valves, orifices, sensors, and pumps positioned in the reductant extraction passage 184, reductant dosing passage 186, and reductant return passage 188.

As mentioned above, one example of a reductant is a solution having 32.5% high purity urea and 67.5% deionized water (e.g., DEF), which decomposes as it travels through the decomposition tube 160 to produce ammonia. The ammonia reacts with $NO_x$ in the presence of the SCR catalyst 170, and it reduces the $NO_x$ to less harmful emissions, such as $N_2$ and $H_2O$. The SCR catalyst 170 may be any of various catalysts known in the art. For example, in some embodiments, the SCR catalyst 170 may be a vanadium-based catalyst. But in other embodiments, the SCR catalyst 170 may be a zeolite-based catalyst, such as a Cu-zeolite or a Fe-zeolite.

The AOC 174 may be any of various flowthrough catalysts configured to react with ammonia to produce mainly nitrogen. Generally, the AOC 174 is utilized to remove ammonia that has slipped through or exited the SCR catalyst 170. As shown, the AOC 174 and the SCR catalyst 170 may be positioned within the same housing. But in other embodiments, they may be separate from one another.

The aftertreatment system 120 shows a one DOC 163, a one DPF 164, one SCR catalyst 170, and one AOC 174—all within a specific order relative to one another. But in other embodiments, the aftertreatment system 120 may have greater or fewer exhaust aftertreatment devices than shown, and they may be in a different order (without departing from the essence of the disclosure).

Figure 2:
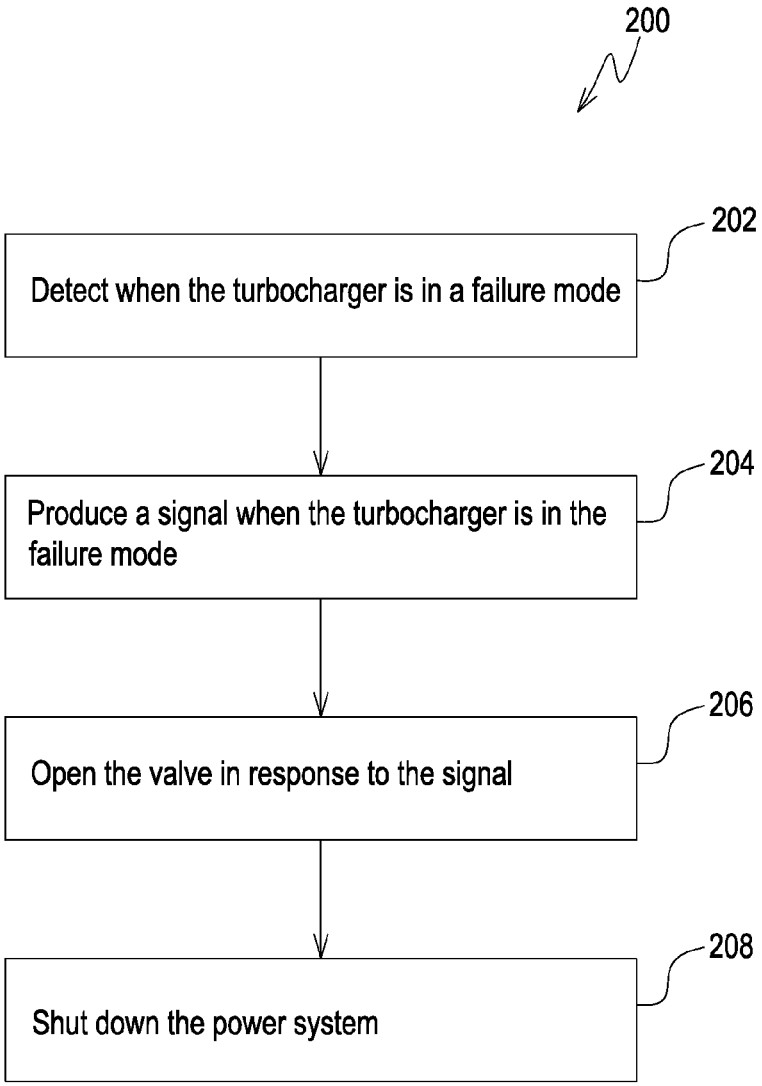
FIG. 2 is a flowchart of a method for using the turbocharger bypass passage.

In FIG. 2, there is shown a method 200 for operating the power system 100. Act 202 of the method 200 is to detect when the turbocharger 108 is in a failure mode. Act 204 is to produce a signal when the turbocharger 108 is in the failure mode. Act 206 is to open the valve 146 in response to the signal. And act 208 is to shutdown the power system 100 after opening the valve 146 in response to the signal.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A power system, comprising:

a turbocharger;

an oil sump;

a supply passage positioned fluidly between the turbocharger and the oil sump, the supply passage configured to supply oil to the turbocharger;

a return passage positioned fluidly between the turbocharger and oil sump, the return passage being configured to return oil from the turbocharger to the oil sump; and a turbocharger bypass passage positioned fluidly between the supply passage and the return passage, the turbocharger bypass passage comprising a valve, the valve being configured to be in a closed positioned when the turbocharger is in a normal operating mode, and the valve being configured to be in an open position when the turbocharger is in a failure mode.

2. The power system of claim 1, wherein the turbocharger and the valve are positioned in parallel relative to one another.

3. The power system of claim 1, wherein the turbocharger is positioned such that, when the turbocharger is in the failure mode, gravity urges the oil to flow away from the turbocharger and towards the turbocharger bypass passage and the return passage.

4. The power system of claim 1, wherein the supply passage comprises an oil filter.

5. The power system of claim 1, wherein the supply passage and the return passage and the turbocharger bypass passage are all stainless steel, braided hoses.

6. The power system of claim 1, wherein there is not a valve positioned in the supply passage.

7. The power system of claim 1, wherein the turbocharger bypass passage and the supply passage and the return passage are all rigid tubes.

8. The power system of claim 1, wherein the turbocharger bypass passage is welded to the supply passage and to the return passage.

9. The power system of claim 1, wherein the valve is a check valve, and the check valve is configured to prevent the oil from flowing away from the return passage and towards the supply passage.

10. The power system of claim 9, wherein the check valve is electronically actuated in response to a signal indicating when the turbocharger is in the normal operating mode and to a signal indicating when the turbocharger is in the failure mode.

11. The power system of claim 10, wherein the check valve comprises an electrical connection, the check valve comprises a first side and a second side, the turbocharger bypass passage comprises a first portion and a second portion, the first portion is positioned between the supply passage and the first side of the check valve, the second portion is positioned between the return passage and the second side of the check valve, the electrical connection is positioned on the second side of the check valve.

12. A method for a power system, the power system comprising a turbocharger; an oil sump; a supply passage positioned fluidly between the turbocharger and the oil sump, the supply passage configured to supply oil to the turbocharger; a return passage positioned fluidly between the turbocharger and oil sump, the return passage being configured to return oil from the turbocharger to the oil sump; and a turbocharger bypass passage positioned fluidly between the supply passage and the return passage, the turbocharger bypass passage comprising a valve, the method comprising:

detecting when the turbocharger is in a failure mode;

producing a signal when the turbocharger is in the failure mode; and opening the valve in response to the signal.

13. The method of claim 12, comprising shutting down the power system after opening the valve in response to the signal.

* * * * *